US005499614A

United States Patent [19]

Busato et al.

[11] Patent Number: 5,499,614

[45] Date of Patent: Mar. 19, 1996

[54] MEANS AND METHOD FOR OPERATING EVAPORATIVE EMISSION SYSTEM LEAK DETECTION PUMP

[75] Inventors: Murray F. Busato; Paul D. Perry; John E. Cook, all of Chatham, Canada

[73] Assignee: Siemens Electric Limited, Chatham, Canada

[21] Appl. No.: 333,824

[22] Filed: Nov. 3, 1994

[51] Int. Cl.[6] ..... F02M 33/02

[52] U.S. Cl. ..... 123/520; 123/198 D

[58] Field of Search ..... 123/520, 198 D, 123/518, 519, 516, 521

[56] References Cited

U.S. PATENT DOCUMENTS

| | | | |
|---|---|---|---|
| 5,048,493 | 9/1991 | Orzel | 123/520 |
| 5,143,035 | 9/1992 | Kayanoma | 123/198 D |
| 5,146,902 | 9/1992 | Cook | 123/518 |
| 5,191,870 | 3/1993 | Cook | 123/198 D |
| 5,193,512 | 3/1993 | Steinbrenner | 123/198 D |
| 5,216,995 | 6/1993 | Hosoda | 123/520 |
| 5,230,319 | 7/1993 | Otsuka | 123/198 D |
| 5,363,824 | 11/1994 | Yamashita | 123/520 |
| 5,383,437 | 1/1995 | Cook | 123/520 |
| 5,411,004 | 5/1995 | Busato | 123/520 |

*Primary Examiner*—Carl S. Miller
*Attorney, Agent, or Firm*—Russel C. Wells

[57] ABSTRACT

An on-board diagnostic system for an evaporative emission control system of an internal combustion engine powered vehicle employs a positive displacement reciprocating pump to create in evaporative emission space a pressure that differs significantly from ambient atmospheric pressure. The pump is powered by using engine intake manifold vacuum to force an intake stroke during which both an internal spring is increasingly compressed and a charge of ambient atmospheric air is created in an air pumping chamber space. Vacuum is then removed, and the spring relaxes to force a compression stroke wherein a portion of the air charge is forced into the evaporative emission space. The pump operation is under the control of a computer that contains an algorithm for operating the pump in particular modes of operation to arrive at a decision concerning integrity of the evaporative emission space against leakage.

20 Claims, 3 Drawing Sheets

MEANS AND METHOD FOR OPERATING EVAPORATIVE EMISSION SYSTEM LEAK DETECTION PUMP

FIELD OF THE INVENTION

This invention relates to evaporative emission control systems for the fuel systems of internal combustion engine powered automotive vehicles, particularly to apparatus and method for ascertaining the integrity of an evaporative emission control system against leakage.

BACKGROUND OF THE INVENTION

A typical evaporative emission control system in a modern automotive vehicle comprises a vapor collection canister that collects volatile fuel vapors generated in the headspace of the fuel tank by the volatilization of liquid fuel in the tank. During conditions conducive to purging, the evaporative emission space which is cooperatively defined by the tank headspace and the canister is purged to the engine intake manifold by means of a canister purge system that comprises a canister purge solenoid valve connected between the canister and the engine intake manifold and operated by an engine management computer. The canister purge solenoid valve is opened by a signal from the engine management computer in an amount that allows the intake manifold vacuum to draw volatile vapors from the canister for entrainment with the combustible mixture passing into the engine's combustion chamber space at a rate consistent with engine operation to provide both acceptable vehicle driveability and an acceptable level of exhaust emissions.

Certain regulations require that certain future automotive vehicles powered by internal combustion engines which operate on volatile fuels such as gasoline have their evaporative emission control systems equipped with on-board diagnostic capability for determining if a leak is present in the evaporative emission space. It has heretofore been proposed to make such a determination by temporarily creating a pressure condition in the evaporative emission space which is substantially different from the ambient atmospheric pressure, and then watching for a change in that substantially different pressure which is indicative of a leak.

Commonly owned U.S. Pat. No. 5,146,902 "Positive Pressure Canister Purge System Integrity Confirmation" discloses a system and method for making such a determination by pressurizing the evaporative emission space by creating a certain positive pressure therein (relative to ambient atmospheric pressure) and then watching for a drop in that pressure indicative of a leak. Leak integrity confirmation by positive pressurization of the evaporative emission space offers certain benefits over leak integrity confirmation by negative pressurization, as mentioned in the referenced patent.

The invention of commonly owned U.S. Ser. No. 07/995,484, filed 23 Dec. 1992, and subsequently published as WO 94/15090 on 07 Jul. 1994, discloses means and method for measuring the effective orifice size of relatively small leakage from the evaporative emission space once the pressure has been brought substantially to a predetermined magnitude that is substantially different from ambient atmospheric pressure. Generally speaking, this involves the use of a reciprocating pump to create such pressure magnitude in the evaporative emission space and a switch that is responsive to reciprocation of the pump mechanism. More specifically, the pump comprises a movable wall that is reciprocated over a cycle which comprises an intake stroke and a compression stroke to create such pressure magnitude in the evaporative emission space. On an intake stroke, a charge of atmospheric air is drawn in an air pumping chamber space of the pump. On an ensuing compression stroke, the movable wall is urged by a mechanical spring to compress a charge of air so that a portion of the compressed air charge is forced into the evaporative emission space. On a following intake stroke, another charge of atmospheric air is created.

At the beginning of the integrity confirmation procedure, the pump reciprocates rapidly, seeking to build pressure toward a predetermined level. If a gross leak is present, the pump will be incapable of pressurizing the evaporative emission space to the predetermined level, and hence will keep reciprocating rapidly. Accordingly, continuing rapid reciprocation of the pump beyond a time by which the predetermined pressure should have been substantially reached will indicate the presence of a gross leak, and the evaporative emission control system may therefore be deemed to lack integrity.

The pressure which the pump strives to achieve is set essentially by its aforementioned mechanical spring. In the absence of a gross leak, the pressure will build toward the predetermined level, and the rate of reciprocation will correspondingly diminish. For a theoretical condition of zero leakage, the reciprocation will cease at a point where the spring is incapable of forcing any more air into the evaporative emission space.

Leaks smaller than a gross leak are detected in a manner that is capable of giving a measurement of the effective orifice size of leakage, and consequently the invention of the earlier application is capable of distinguishing between very small leakage which may be deemed acceptable and somewhat larger leakage which, although considered less than a gross leak, may nevertheless be deemed unacceptable. The ability to provide some measurement of the effective orifice size of leakage that is smaller than a gross leak, rather than just distinguishing between integrity and non-integrity, may be considered important for certain automotive vehicles.

The means for obtaining the measurement comprises a switch which, as an integral component of the pump, is disposed to sense reciprocation of the pump mechanism. Such a switch may be a reed switch, an optical switch, or a Hall sensor, for example. The switch is used both to cause the pump mechanism to reciprocate at the end of a compression stroke and as an indication of how fast air is being pumped into the evaporative emission space. Since the rate of pump reciprocation will begin to decrease as the pressure begins to build, detection of the rate of switch operation can be used in the first instance to determine whether or not a gross leak is present. As explained above, a gross leak is indicated by failure of the rate of switch operation to fall below a certain frequency within a certain amount of time. In the absence of a gross leak, the frequency of switch operation provides a measurement of leakage that can be used to distinguish between integrity and non-integrity of the evaporative emission space even though the leakage has already been determined to be less than a gross leak. Once the evaporative emission space pressure has built substantially to the predetermined pressure, the switch's indication of a pump reciprocation rate at less than a certain frequency will indicate integrity of the evaporative emission space while indication of a greater frequency will indicate non-integrity.

SUMMARY OF THE INVENTION

The present invention relates to an improvement in an on-board diagnostic system for an evaporative emission control system wherein the diagnostic system includes a leak detection pump as disclosed in the above referenced patent application. More specifically, the improvement concerns a means and method for operating the leak detection pump in an efficient manner that is especially conducive for microprocessor-based control. The preferred embodiment of the invention that will be disclosed herein is in the form of an algorithm that is programmed into a microprocessor, and then executed by the microprocessor whenever a diagnostic leakage test is to be performed on certain related portions of the fuel and evaporative emission control systems.

The foregoing, along with additional features, advantages, and benefits of the invention, will be seen in the ensuing description and claims which should be considered in conjunction with the accompanying drawings. The drawings disclose a presently preferred embodiment of the invention according to the best mode contemplated at this time for carrying out the invention.

DESCRIPTION OF THE PREFERRED EMBODIMENT

Figure 1:
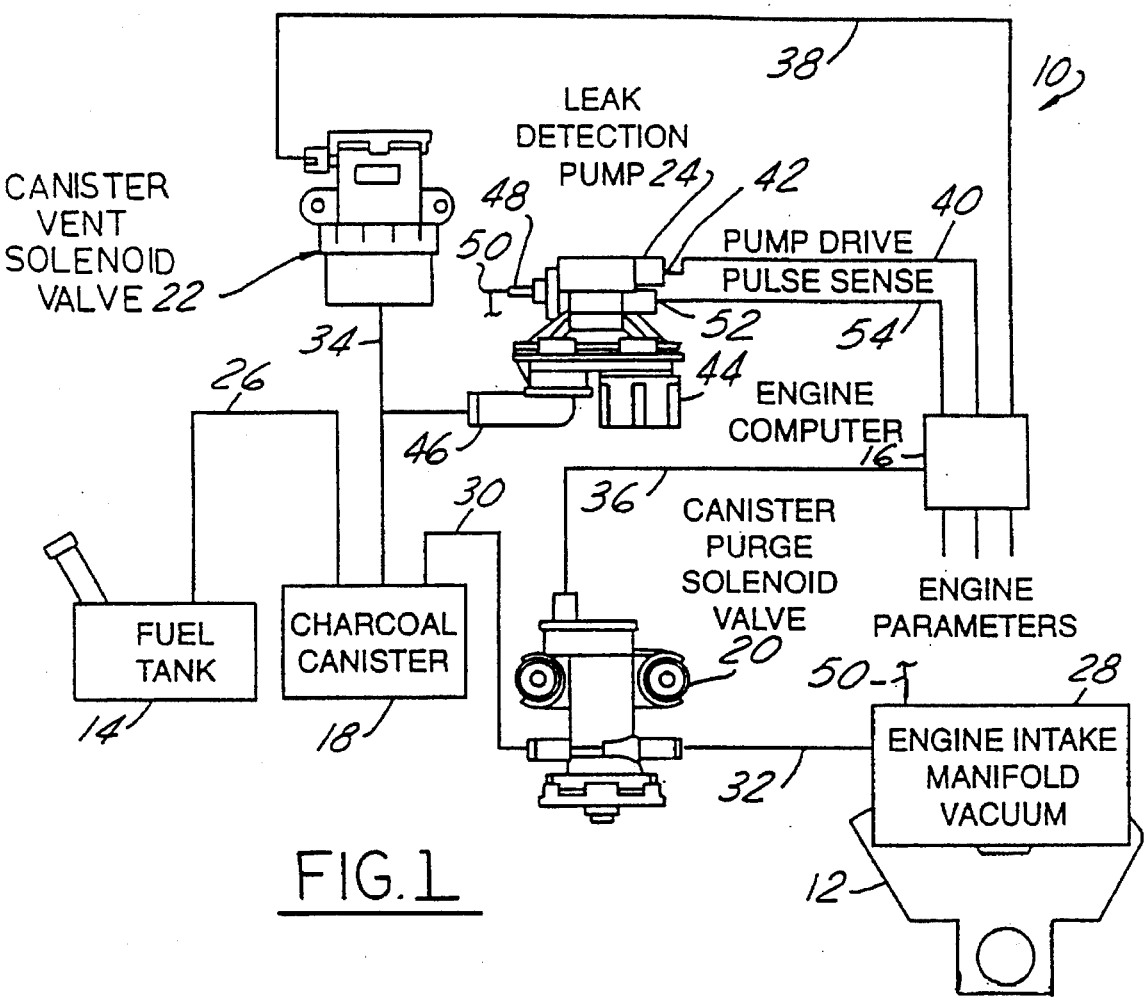
FIG. 1 is a general schematic diagram of an evaporative emission control system including diagnostics embodying principles of the present invention, and relevant portions of an automobile.

FIG. 1 shows an evaporative emission control (EEC) system 10 for an internal combustion engine powered automotive vehicle comprising in association with the vehicle's engine 12, fuel tank 14, and engine management computer 16, a conventional vapor collection canister (charcoal canister) 18, a canister purge solenoid (CPS) valve 20, a canister vent solenoid (CVS) valve 22, and a leak detection pump 24.

The headspace of fuel tank 14 is placed in fluid communication with an inlet port of canister 18 by means of a conduit 26 so that they cooperatively define an evaporative emission space within which fuel vapors generated from the volatilization of fuel in the tank are temporarily confined and collected until purged to an intake manifold 28 of engine 12. A second conduit 30 fluid-connects an outlet port of canister 18 with an inlet port of CPS valve 20, while a third conduit 32 fluid-connects an outlet port of CPS valve 20 with intake manifold 28. A fourth conduit 34 fluid-connects a vent port of canister 18 with an inlet port of CVS valve 22. CVS valve 22 also has an outlet port that communicates directly with atmosphere.

Engine management computer 16 receives a number of inputs (engine parameters) relevant to control of the engine and its associated systems, including EEC system 10. One output port of the computer controls CPS valve 20 via a circuit 36, another, CVS valve 22 via a circuit 38, and another, leak detection pump 24 via a circuit 40. Circuit 40 connects to an input port 42 of pump 24.

Pump 24 comprises an air inlet port 44 that is open to ambient atmospheric air and an outlet port 46 that is fluid-connected into conduit 34 by means of a tee. The pump also has a vacuum inlet port 48 that is communicated by a conduit 50 with intake manifold 28. Still further, the pump has an output port 52 at which it provides a signal that is delivered via a circuit 54 to computer 16.

While the engine is running, operation of pump 24 is commanded from time to time by computer 16 as part of an occasional diagnostic procedure for ascertaining whether EEC system 10 is leaking to atmosphere. During occurrences of such diagnostic procedure, computer 16 commands both CPS valve 20 and CVS valve 22 to close. At times of engine running other than during such occurrences of the diagnostic procedure, pump 24 does not operate, computer 16 opens CVS valve 22, and computer 16 selectively operates CPS valve 20 such that CPS valve 20 opens under conditions conducive to purging and closes under conditions not conducive to purging. Thus, during times of operation of the automotive vehicle, the canister purge function is performed in the usual manner for the particular vehicle and engine so long as the diagnostic procedure is not being performed. When the diagnostic procedure is being performed, the evaporative emission space is closed so that it can be pressurized by pump 24.

Figure 2:
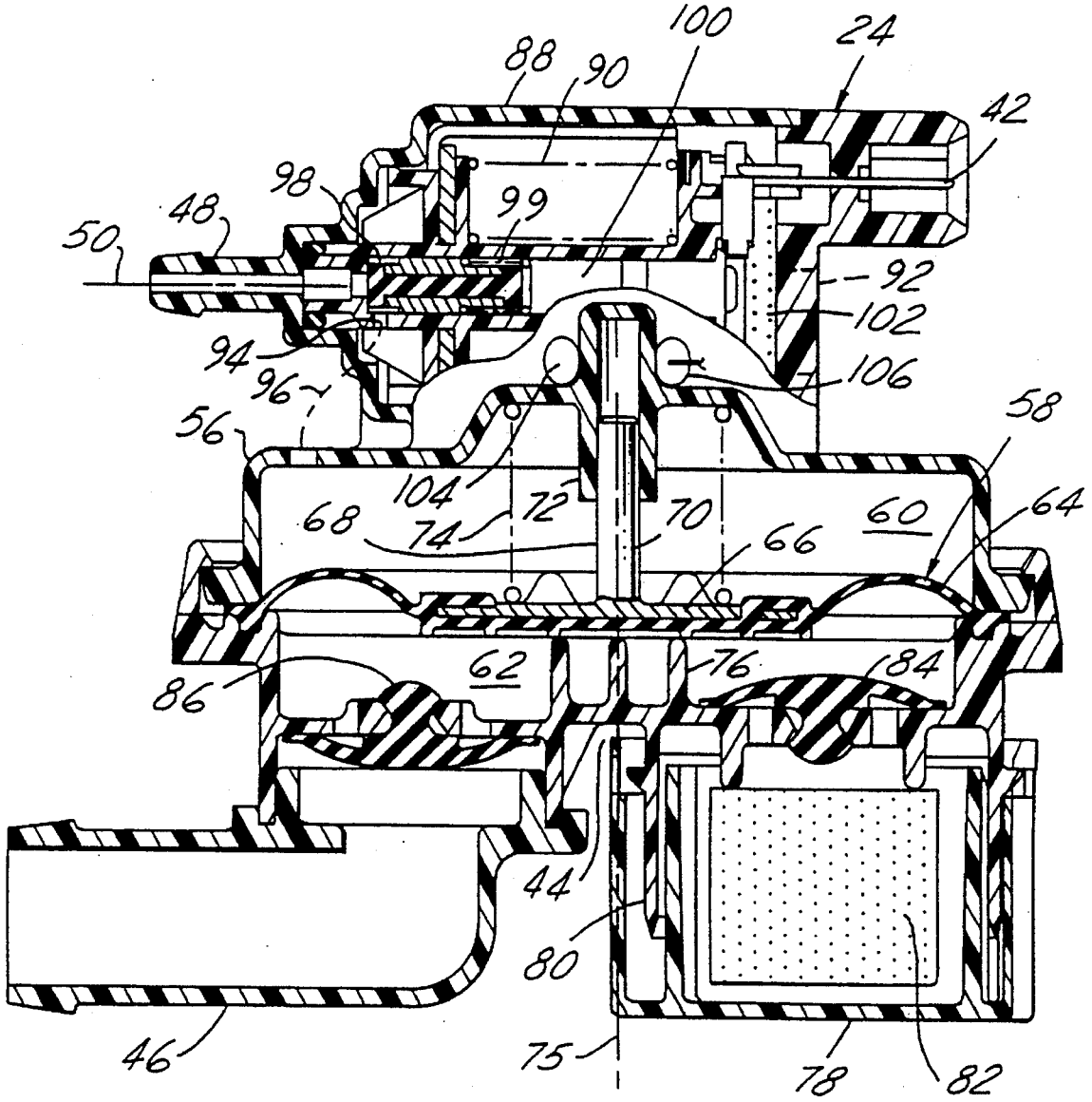
FIG. 2 is a longitudinal cross sectional view of the leak detection pump of FIG. 1, by itself.

Attention is now directed to details of pump 24 with reference to FIG. 2. Pump 24 comprises a housing 56 composed of several plastic parts assembled together. Interior of the housing, a movable wall 58 divides housing 56 into a vacuum chamber space 60 and an air pumping chamber space 62. Movable wall 58 comprises a general circular diaphragm 64 that is flexible, but essentially non-stretchable, and that has an outer peripheral margin captured in a sealed manner between two of the housing parts. The generally circular base 66 of an insert 68 is held in assembly against a central region of a face of diaphragm 64 that is toward chamber space 60. A cylindrical shaft 70 projects centrally from base 66 into a cylindrical sleeve 72 formed in one of the housing parts. A mechanical spring 74 in the form of a helical metal coil is disposed in chamber space 60 in outward circumferentially bounding relation to shaft 70, and its axial ends are seated in respective seats formed in base 66 and that portion of the housing bounding sleeve 72. Spring 74 acts to urge movable wall 58 axially toward chamber space 62 while the coaction of shaft 70 with sleeve 72 serves to constrain motion of the central region of the movable wall to straight line motion along an imaginary axis 75. The position illustrated by FIG. 2 shows spring 74 forcing a central portion of a face of diaphragm 58 that is toward chamber space 62 against a stop 76, and this represents the position which the mechanism assumes when the pump is not being operated.

Inlet port 44 leads to chamber space 62 while outlet port 46 leads from chamber space 62. Inlet port 44 comprises a cap 78 that is fitted onto a neck 80 of housing 56 such that the two form a somewhat tortuous, but not significantly restricted, path for ambient air to pass through before it can enter chamber space 62. A filter element 82 is also disposed in association with cap 78 and neck 80 such that air can enter chamber space 62 only after it has passed through the filter element. In this way, only filtered air reaches the interior mechanism of the pump.

The wall of housing 56 where inlet air enters chamber space 62 contains a one-way valve 84 that allows air to pass into, but not from, the chamber space via inlet port 44. The illustrated valve is a conventional umbrella-type valve having a stem that is retentively fitted to a hole in the housing wall and a dome whose peripheral margin selectively seals against the wall in outwardly spaced relation to several through-holes in the wall via which air enters chamber space 62. Outlet port 46 comprises a one-way valve 86 which is arranged on the housing wall exactly like valve 84 but in a sense that allows air to pass from, but not enter, chamber space 62 via outlet port 46.

A solenoid valve 88 is disposed atop housing 56, as appears in FIG. 2. Valve 88 comprises a solenoid 90 that is connected with input port 42. In addition to vacuum port 48, valve 88 comprises an atmospheric port 92 for communication with ambient atmosphere and an outlet port 94 that communicates with chamber space 60 by means of an internal passageway 96 that is depicted somewhat schematically in FIG. 2 for illustrative purposes only. Valve 88 further comprises an armature 98 that is biased to the left in FIG. 2 by a spring 99 so that a valve element on the left end of the armature closes vacuum port 48, leaving a valve element on the armature's right end spaced from the left end of a stator 100 that is disposed coaxial with solenoid 90. Atmospheric port 92 has communication with the left end of stator 100 by means of internal passageway structure which includes a filter element 102 between port 92 and the right end of the stator, and a central through-hole extending through the stator from right to left.

In the position depicted by FIG. 2, solenoid 90 is not energized, and so atmospheric port 92 is communicated to chamber space 60, resulting in the latter being at atmospheric pressure. When solenoid 90 is energized, armature 98 moves to the right closing atmospheric port 92 and opening vacuum port 48, thereby communicating vacuum port 48 to chamber space 60.

The pump has two further components, namely a permanent magnet 104 and a reed switch 106. The two are mounted on the exterior of the housing wall on opposite sides of where the closed end of sleeve 72 protrudes. Shaft 70 is a ferromagnetic material, and in the position of FIG. 2, it is disposed below the magnet and reed switch where it does not interfere with the action of the magnet on the reed switch. However, as shaft 70 moves upwardly within sleeve 72, a point will be reached where it shunts sufficient magnetic flux from magnet 104, that reed switch 106 no longer remains under the influence of the magnet, and hence the reed switch switches from one state to another. Let it be assumed that the reed switch switches from open to closed at such switch point, being open for positions below the switch point and closed for positions above the switch point. This switch point is however significantly below the uppermost limit of travel of the shaft, such limit being defined in this particular embodiment by abutment of the upper end of shaft 70 with the closed end wall of sleeve 72. For all upward travel of shaft 70 above the switch point, reed switch 106 remains closed. When shaft 70 once again travels downwardly, reed switch 106 will revert to open upon the shaft reaching the switch point. Reed switch 106 is connected with output port 52 so that the reed switch's state can be monitored by computer 16.

Sufficient detail of FIG. 2 having thus been described, the general operation of the pump may now be explained. When a diagnostic test is to be performed, computer 16 commands both CPS valve 20 and CVS valve 22 to be closed. It then energizes solenoid 90 causing intake manifold vacuum to be delivered through valve 88 to vacuum chamber space 60. For the typical magnitudes of intake manifold vacuum that exist when the engine is running, the area of movable wall 58 is sufficiently large in comparison to the force exerted by spring 74 that movable wall 58 is displaced upwardly, thereby reducing the volume of vacuum chamber space 60 in the process while simultaneously increasing the volume of air pumping chamber space 62. The upward displacement of movable wall 58 is limited by any suitable means of abutment and in this particular embodiment it is, as already mentioned, by abutment of the end of shaft 70 with the closed end wall of sleeve 72.

As the volume of air pumping chamber space 62 increases during the upward motion of movable wall 58, a certain pressure differential is created across one-way valve 84 resulting in the valve opening at a certain relatively small pressure differential to allow atmospheric air to pass through inlet port 44 into chamber space 62. When a sufficient amount of ambient atmospheric air has been drawn into chamber space 62 to reduce the pressure differential across valve 84 to a level that is insufficient to maintain the valve open, the valve closes. At this time, air pumping chamber space 62 contains a charge of air that is substantially at ambient atmospheric pressure, i.e. atmospheric pressure less drop across valve 84. This is the reset position of the pump.

Under typical operating conditions, the time required for the charge of atmospheric air to be created in air pumping chamber space 62 is well defined. This information is contained in computer 16 and is utilized by the computer to terminate the energization of solenoid 90 after a time that is sufficiently long enough, but not appreciably longer, to assure that for all anticipated operating conditions, chamber space 62 will be charged substantially to atmospheric pressure with movable wall 58 in its uppermost position of travel. The termination of the energization of solenoid valve 88 by computer 16 immediately causes vacuum chamber space 60 to be vented to atmosphere. The pressure in chamber space 60 now quickly returns to ambient atmospheric pressure, causing the net force acting on movable wall 58 to be essentially solely that of spring 74.

The spring force now displaces movable wall 58 downwardly compressing the air in chamber space 62. When the charge of air has been compressed sufficiently to create a certain pressure differential across one-way valve 86, the latter opens. Continued displacement of movable wall 58 by spring 74 forces some of the compressed air in chamber space 62 through outlet port 46 and into the evaporative emission space.

When movable wall 58 has been displaced downwardly to a point where shaft 70 ceases to maintain reed switch 106 closed, the latter opens. The switch opening is immediately detected by computer 16 which immediately energizes solenoid 90 once again. The energizing of solenoid 90 now causes manifold vacuum to once again be applied to chamber space 60, reversing the motion of movable wall 58 from down to up. The downward motion of movable wall 58 between the position at which shaft 70 abuts the closed end wall of sleeve 72 and the position at which reed switch 106 switches from closed to open represents a full compression stroke wherein a charge of air in chamber space 62 is compressed and a portion of the compressed charge is pumped into the evaporative emission space. Upward motion of movable wall 58 from a position at which reed switch 106 switches from open to closed to a position where the end of shaft 72 abuts the closed end of sleeve 70 represents a full intake stroke. It is to be noted that switch 106 will open before movable wall 58 abuts lower limit stop 76, and in this way it is assured that the movable wall will not assume a position that prevents it from being intake-stroked when it is intended that the movable wall should continue to reciprocate after a compression stroke.

At the beginning of a diagnostic procedure, the pressure in the evaporative emission space will be somewhere near atmospheric pressure, and therefore the time required for the pump to execute a full compression stroke will be less than the time required once the pressure has been built up. One aspect of the present invention arises as a result of recognizing that the force exerted by spring 74 is largest proximate the beginning of a compression stroke, progressively diminishing during the execution of a full compression stroke. Accordingly, this aspect of the present invention comprises utilizing only an initial fraction of the compression stroke during an initial pressurizing phase of a diagnostic test. During a succeeding phase, the pump executes full compression strokes.

Figure 3:
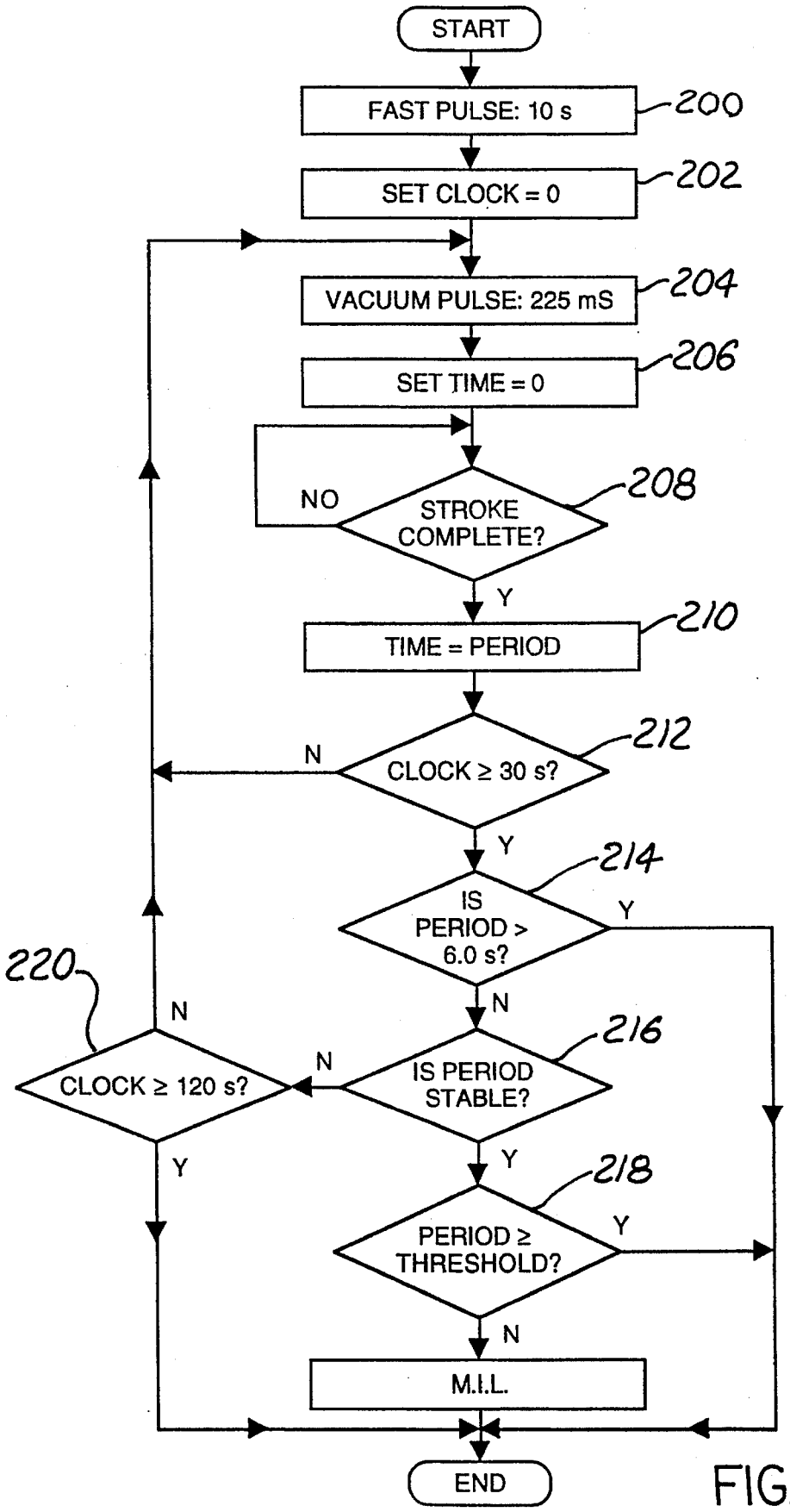
FIG. 3 is a flow diagram depicting diagnostic procedure.

FIG. 3 depicts a flow diagram in accordance with inventive principles. This flow diagram represents a program that has been programmed into engine computer 16 for performing the diagnostic test. In general, the program may be considered to comprise three segments: (1) pressurization, (2) measurement, and (3) decision. It is preferable that the diagnostic test be run immediately after engine key-up, when manifold vacuum has stabilized to a value greater than 153 mm (6 inches) of mercury and the difference between engine cooling temperature and ambient temperature is less than 10° C. These three program segments will now be described.

(1) Pressurization

The system must be stabilized at test pressure before a measurement can be taken. To expedite this process, the pump is operated initially in a "fast pulse" mode for a time depending on the fuel system capacity. This mode comprises utilizing only an initial fraction of a full compression stroke. Since in-tank pressure is essentially at atmosphere at the beginning of the test under the preferred ambient conditions, and since the time required for the pump to pump a charge of atmospheric air into such a pressure will be known, the program can contain parameters setting the rate at which the pump's vacuum chamber space is switched back from atmosphere to manifold vacuum so as to assure that the pump will execute only an initial fraction of a compression stroke. In this way, it is unnecessary for the pump to have an additional sensor for sensing when the diaphragm has traveled a desired initial fraction of a full compression stroke although alternatively such a sensor could be employed, if desired. This initial "fast pulse" mode, referred to in FIG. 3 by the flow diagram step 200, is allowed to continue for a certain amount of time (10 seconds for the example), which is shown as preset, but could, if desired, be made a function of the particular fuel tank size and fill level. In the example, the pump is reset with a 225 ms vacuum pulse every 600 ms (frequency=1.67 Hz). This "fast pulse" mode will increase system pressure at a much faster rate by taking advantage of the stronger spring forces that are delivered proximate the beginning of the pump compression stroke.

Next, after the "fast pulse" mode, the pump operates in a "full compression stroke" mode that allows it to continue to build pressure at a rate that is a function of the pressure in the system and the force characteristics of spring 74. A timer in computer 16 (called CLOCK) is started (step 202) at the beginning of this "full compression stroke" mode. The pump is allowed to execute full compression strokes for a certain time, approximately 30 seconds in the example. This segment of time is required to allow the system pressure time to begin to stabilize and to avoid spurious malfunction indicator lamp (M.I.L.) signals. This "full compression stroke" mode is represented by steps 204, 206, 208, 210, 212 in FIG. 3. The time of each full compression stroke is recorded in engine computer 16 as a respective value of a variable called "PERIOD" so that over the time allotted to the "full compression stroke" mode, a number of values of "PERIOD" will have been recorded.

(2) Measurement

Computer 16 calculates a running average of a number (typically three or possibly more) of most recent values of "PERIOD" recorded as the "full compression stroke" mode proceeds. Attainment of "Stability" in the "PERIOD" measurements is determined by calculating the difference between this running average and the time measurement of the next full compression stroke. When this difference falls below a preset "stability factor" (i.e., 0.1 seconds in the example), the system is considered to be at a stable pressure. A system can be stable even if it is leaking, with such stability occurring when the pump operates at a rate equal to the rate at which leakage from the system is occurring.

The measurement segment ends either when the pump period is stable, a compression stroke exceeds a time indicating a sealed system (six seconds in the example), or the overall test time exceeds a certain maximum indicating that the pressure will not stabilize (120 seconds in the example).

(3) Decision

Based on the three outcomes listed above, the following actions will be taken:

(a) If a measured value of "PERIOD" exceeds six seconds at any time during the measurement phase, the system is apparently sealed and therefore a PASS is logged (step 214). If no such value is measured, it must be determined if "Stability" has been attained (step 216).

(b) After "Stability" attainment, the latest measurement of "PERIOD" is compared to a predetermined "threshold" (i.e., 2.75 seconds in the example). (Step 218) If this value of "PERIOD" is greater than "threshold", then the diagnostic test has been passed and a PASS is logged. Otherwise the test has failed, and a M.I.L. fault is logged. An example of a fault that might be logged is a gross leak where the pump operates continuously at its maximum rate.

(c) If "Stability" is not attained and the total test time exceeds 120 seconds (Step 220), there is typically some external influence on the system that prevents stability attainment, and therefore the system is determined to be unstable, and a test malfunction is logged.

A lack of integrity may be due to any one or more of a number of reasons. For example, there may be leakage from fuel tank 14, canister 18, or any of the conduits 26, 30, and 34. Likewise, failure of either CPS valve 20 or CVS valve 22 to fully close during the procedure will also be a source of leakage and can be detected. Even though the mass of air that is pumped into the evaporative emission space will to some extent be an inverse function of the pressure in that space, the pump may be deemed a positive displacement pump because of the fact that it reciprocates over a fairly well defined stroke.

The memory of computer 16 may be used as a means to log the test results. The automobile may also contain an indicating means such as the M.I.L. light that draws the attention of the driver to the test results, such an indicating means typically being in the instrument panel display. If a diagnostic procedure indicates that the evaporative emission system has integrity, it may be deemed unnecessary for the result to be automatically displayed to the driver; in other words, automatic display of a test result may be given to the driver only in the event of an indication of non-integrity.

An additional requirement of the on-board diagnostic regulation is a flow test of the evaporative emission system. Flow could be prevented by a blockage in conduit 26 or conduit 30 shown in FIG. 1. The present invention has the capability of making this test by adding steps to the present test procedure shown in FIG. 3.

A blockage in conduit 26 can be detected by inserting a test between the "Start" and "Fast Pulse" sections of the procedure. The blockage in this conduit will significantly reduce the volume that must be pressurized and hence cause an abnormal reduction in the rate of reciprocation over a short test period. Engine management computer 16 will operate the pump in the "full compression stroke" mode and the time between compression strokes will be measured and compared to the time of the previous stroke. Flow through conduit 26 would be deemed acceptable if the time between compression strokes is below a specified threshold after a specified number of pump cycles (i.e., one second after five compression strokes for example).

A blockage in conduit 30 can be detected by inserting a test after the final "Period" measurement. Blockage in this location will prevent flow between canister 18 and engine intake manifold 28 and hence prevent the accumulated test pressure from bleeding to the intake manifold if the CPS valve 20 were opened. To detect this condition, computer 16 would continue to operate the pump in the full "compression stroke" mode and the time between compression strokes would be measured and compared to the time of the previous stroke. The computer would open the CPS and allow the test pressure to bleed to the intake manifold. The time between compression strokes will decrease as the pump attempts to maintain the test pressure. Flow through conduit 30 would be deemed acceptable if the time between compression strokes is below a specified minimum value after a prescribed period (i.e., one second maximum after ten seconds).

While a presently preferred embodiment of the invention has been illustrated and described, it should be appreciated that principles are applicable to other embodiments that fall within the scope of the following claims. An example of such an embodiment could comprise an electric actuator to stroke the movable wall. Of course, any particular embodiment of the invention for a particular usage is designed in accordance with established engineering calculations and techniques, using materials suitable for the purpose. Programming of computer 16 to perform the disclosed algorithm of FIG. 3 can be performed by conventional programming techniques based on the flow diagram disclosure contained herein.

What is claimed is:

1. An automotive vehicle comprising an internal combustion engine and a fuel system for said engine which comprises a fuel tank for storing volatile liquid fuel for the engine and an evaporative emission control system which comprises a collection canister that in cooperative combination with headspace of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, said pump means comprising a positive displacement reciprocating pump having a mechanism that, while said valve means is closed to prevent communication of said evaporative emission space to atmosphere and while said canister purge valve is closed to prevent communication of said evaporative emission space to said intake manifold, executes reciprocating motion comprising an intake stroke and a compression stroke and that comprises means to intake air during each occurrence of an intake stroke for creating a measured charge volume of air at given pressure and means to compress a measured charge volume of air to pressure greater than such given pressure and force a portion thereof into said evaporative emission space during each occurrence of a compression stroke, said means to compress a measured charge volume of air to pressure greater than such given pressure and force a portion thereof into said evaporative emission space during each occurrence of a compression stroke comprises mechanical spring means to which energy in imparted during an intake stroke and which releases energy during a compression stroke, characterized in that;

operation of the pump is under control of a computer a) that causes the pump to operate initially in a first mode that accelerates initial pressurizing of said space by causing said movable wall to repeatedly execute less than a full compression stroke beginning at an initial position wherein maximum energy is stored in said spring means and ending before completing a full compression stroke, and b) that at the conclusion of said first mode causes the pump to operate in a second mode wherein said movable wall is caused to repeatedly execute full compression strokes.

2. An automotive vehicle as set forth in claim 1 characterized further in that during said second mode, said computer measures time required to execute a full compression stroke and ascertains if a predefined degree of stabilization of pressure in said space has been attained.

3. An automotive vehicle as set forth in claim 2 characterized further in that once the computer has ascertained attainment of such predefined degree of stabilization of pressure in said space, the computer further determines the extent of any leakage from said space.

4. An automotive vehicle as set forth in claim 3 characterized further in that the computer ascertains if such predefined degree of stabilization of pressure in said space has been attained by averaging the times of a number of previously completed full compression strokes and comparing the time of the most recent full compression stroke to such average.

5. An automotive vehicle as set forth in claim 4 characterized further in that the computer indicates the attainment of such predefined degree of stabilization of pressure in said space when the comparison indicates the attainment of a predetermined relationship between such average and the time of the most recent full compression stroke.

6. An automotive vehicle as set forth in claim 5 characterized further in that the computer obtains the difference between the time of the most recent full compression stroke and such average and determines that such predefined degree of stabilization has been attained when such difference is smaller than a certain amount.

7. An automotive vehicle as set forth in claim 6 characterized further in that said computer causes the pump operation to terminate if such predefined degree of stabilization of pressure is not attained within a certain amount of time.

8. An automotive vehicle as set forth in claim 2 characterized further in that said computer causes the pump operation to terminate if such predefined degree of stabilization of pressure is not attained within a certain amount of time.

9. An automotive vehicle comprising an internal combustion engine and a fuel system for said engine which comprises a fuel tank for storing volatile liquid fuel for the engine and an evaporative emission control system which comprises a collection canister that in cooperative combination with headspace of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, said pump means comprising a positive displacement reciprocating pump having a mechanism that, while said valve means is closed to prevent communication of said evaporative emission space to atmosphere and while said canister purge valve is closed to prevent communication of said evaporative emission space to said intake manifold, executes reciprocating motion comprising an intake stroke and a compression stroke and that comprises means to intake air during each occurrence of an intake stroke for creating a measured charge volume of air at given pressure and means to compress a measured charge volume of air to pressure greater than such given pressure and force a portion thereof into said evaporative emission space during each occurrence of a compression stroke, said means to compress a measured charge volume of air to pressure greater than such given pressure and force a portion thereof into said evaporative emission space during each occurrence of a compression stroke comprises mechanical spring means to which energy in imparted during an intake stroke and which releases energy during a compression stroke, characterized in that:

operation of the pump is under control of a computer that causes the pump to operate in a mode wherein said movable wall executes compression strokes of like stroke length, said computer measures time required to execute a compression stroke and ascertains if a predefined degree of stabilization of pressure in said space has been attained by averaging the times of a number of previously completed compression strokes and comparing the time of the most recent compression stroke to such average.

10. An automotive vehicle as set forth in claim 9 characterized further in that once the computer has ascertained attainment of such predefined degree of stabilization of pressure in said space, the computer further determines the extent of any leakage from said space.

11. An automotive vehicle as set forth in claim 10 characterized further in that the computer obtains the difference between the time of the most recent compression stroke and such average and determines that such predefined degree of stabilization has been attained when such difference is smaller than a certain amount.

12. An automotive vehicle as set forth in claim 11 characterized further in that said computer causes the pump operation to terminate if such predefined degree of stabilization of pressure is not attained within a certain amount of time.

13. An automotive vehicle as set forth in claim 9 characterized further in that said computer causes the pump operation to terminate if such predefined degree of stabilization of pressure is not attained within a certain amount of time.

14. A method for distinguishing between integrity and non-integrity of an evaporative emission control system of an internal combustion engine powered automotive vehicle having a fuel tank for storing volatile liquid fuel for the engine, said evaporative emission control system comprising a collection canister that in cooperative combination with headspace of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, and valve means via which said evaporative emission space is selectively communicated to atmosphere, said method comprising closing both said valve means and said canister purge valve, and while they are closed, pressurizing said evaporative emission space to a pressure that is significantly different from atmospheric pressure by means of a reciprocating pump that contains a mechanical spring means from which energy is extracted during a compression stroke of the pump to pressurize said space, characterized in that:

a) the pump operates initially in a first mode that accelerates initial pressurizing of said space by causing said pump to repeatedly execute less than a full compression stroke beginning at an initial position wherein maximum energy is stored in said spring means and ending before completing a full compression stroke, and b) at the conclusion of said first mode, the pump operates in a second mode wherein the pump repeatedly executes full compression strokes.

15. A method as set forth in claim 14 characterized further in that during said second mode, time required to execute a full compression stroke is measured and such measurement is utilized to ascertain attainment of a predefined degree of stabilization of pressure in said space.

16. An automotive vehicle as set forth in claim 15 characterized further in that once attainment of such predefined degree of stabilization of pressure in said space has been ascertained, the extent of any leakage from said space is ascertained.

17. An automotive vehicle as set forth in claim 16 characterized further in that attainment of such predefined degree of stabilization of pressure in said space is ascertained by averaging the times of a number of previously completed full compression strokes and comparing the time of the most recent full compression stroke to such average.

18. A method for distinguishing between integrity and non-integrity of an evaporative emission control system of an internal combustion engine powered automotive vehicle having a fuel tank for storing volatile liquid fuel for the engine, said evaporative emission control system comprising a collection canister that in cooperative combination with headspace of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, and valve means via which said evaporative emission space is selectively communicated to atmosphere, said method comprising closing both said valve means and said canister purge valve, and while they are closed, pressurizing said evaporative emission space to a pressure that is significantly different from atmospheric pressure by means of a reciprocating pump that contains a mechanical spring means from which energy is extracted during a compression stroke of the pump to pressurize said space, characterized in that:

the pump executes compression strokes of like stroke length, the time required to execute a compression stroke is measured, and a predefined degree of stabilization of pressure in said space is ascertained by averaging the times of a number of previously completed compression strokes and comparing the time of the most recent compression stroke to such average.

19. A method as set forth in claim 18 characterized further in that once such predefined degree of stabilization of pressure in said space has been ascertained, the extent of any leakage from said space is ascertained.

20. A method as set forth in claim 19 characterized further in that pump operation is terminated if such predefined degree of stabilization of pressure is not attained within a certain amount of time.

* * * * *